US008863413B2

(12) United States Patent
Goodin

(10) Patent No.: US 8,863,413 B2
(45) Date of Patent: Oct. 21, 2014

(54) DREDGING APPARATUS

(76) Inventor: Joseph Michael Goodin, New Plymouth (NZ)

( * ) Notice: Subject to any disclaimer, the term of this patent is extended or adjusted under 35 U.S.C. 154(b) by 356 days.

(21) Appl. No.: 13/377,423

(22) PCT Filed: Jun. 10, 2010

(86) PCT No.: PCT/NZ2010/000107

§ 371 (c)(1),
(2), (4) Date: Dec. 9, 2011

(87) PCT Pub. No.: WO2010/143982

PCT Pub. Date: Dec. 16, 2010

(65) Prior Publication Data

US 2012/0085003 A1 Apr. 12, 2012

(30) Foreign Application Priority Data

Jun. 11, 2009 (NZ) ..... 576896

(51) Int. Cl.
*E02F 3/88* (2006.01)
*E02F 3/92* (2006.01)
*E02F 5/00* (2006.01)

(52) U.S. Cl.
CPC ..... *E02F 5/006* (2013.01); *E02F 3/9243* (2013.01)
USPC ..... 37/317

(58) Field of Classification Search
CPC ..... B01F 5/0471; E02F 3/40; E02F 3/92; E02F 3/90; E02F 3/902; E02F 3/925; E02F 3/9293; E02F 5/003; F04F 5/10; F04F 5/466; F04F 5/42
USPC ..... 37/314, 317, 318, 321, 322, 335; 175/66, 67, 206, 213, 424; 298/8, 17; 406/85, 92, 153, 151; 417/179, 181, 417/195, 197, 169, 171
See application file for complete search history.

(56) References Cited

U.S. PATENT DOCUMENTS 3,301,606 A * 1/1967 Bruno ..... 406/85
3,855,367 A 12/1974 Webb
4,240,173 A * 12/1980 Sherrill ..... 15/1.7
4,322,897 A 4/1982 Brassfield (Continued)

FOREIGN PATENT DOCUMENTS

GB 1214322 12/1970

OTHER PUBLICATIONS

International Search Report, PCT/NZ2010/000107, Sep. 29, 2010.

*Primary Examiner* — Robert Pezzuto
(74) *Attorney, Agent, or Firm* — Young & Thompson

(57) ABSTRACT

In a dredging apparatus, a suction head relocates matter by sucking particulate matter from a bed of a body of water. The suction head includes a first conduit (C1) having an inlet; a second conduit (C2) having an inlet and an outlet, connected in series with C1. The C2 outlet opens to the C1 inlet via a mixing region. A third conduit (C3) has an inlet and an outlet, the latter opening to C1 via a restriction and the mixing region. A fluid may be fed under pressure through the C3 inlet and conveyed to the mixing region via the restriction, reducing the pressure of the fluid passing into the mixing region, the reduction causing matter to be sucked through the C2 inlet and conveyed though C2 to the mixing region, the matter being entrained with the fluid and exiting the mixing region via C1.

21 Claims, 7 Drawing Sheets

(56) References Cited

U.S. PATENT DOCUMENTS

| | | | | |
|---|---|---|---|---|
| 4,562,612 A | | 1/1986 | Williams et al. | |
| 4,681,372 A | | 7/1987 | McClure | |
| 4,927,298 A | * | 5/1990 | Tuszko et al. | 406/173 |
| 6,058,630 A | * | 5/2000 | Brown | 37/322 |

* cited by examiner

DREDGING APPARATUS

FIELD OF THE INVENTION

This present invention relates to improvements in and relating to dredging apparatus. In particular, the invention relates to a suction head for relocating matter, such as matter in the form of particulate matter and/or fluid.

An embodiment of the present invention relates to a suction head for a dredging device for relocating particulate matter by sucking the particulate matter from a bed of a body of water.

BACKGROUND

Dredging devices may be used to relocate particulate matter, such as rocks, sand, mud and the like, that is submerged in water. One known dredging device comprises a suction head through which a pressurised fluid is pumped. The fluid is channelled through a venturi to create a pressure differential that causes particulate matter to be sucked into the suction head and entrained with the pressurised fluid. The stream of fluid acts as a transport medium to convey the particulate matter to a different location underwater or a collector above the surface.

This form of dredging device is commonly used in the offshore and onshore oil and mining industries, such as for construction, repair and mining applications, for example. In use, the suction head may be secured to a remotely operated under water vehicle (or "ROV") that may be able to operate in seawater at depths of up to 30,000 feet (around 9,000 meters) or more. The ROV can be controlled remotely from the surface. A surface mounted pump can be used to pump the pressurised fluid to the submerged suction head. Alternatively, the water pump can be mounted directly to the ROV and powered by the ROV or remotely using a surface mounted power source. Alternately, the suction head can be mounted to a frame that can be guided by a diver.

An embodiment of the present invention seeks to provide an improved suction head for a dredging device, or at least to provide the public with a useful choice.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

SUMMARY OF THE INVENTION

The present invention provides a suction head for relocating matter, the suction head comprising:

a first conduit having an inlet;

a second conduit having an inlet and an outlet, the second conduit being in series and in fluid communication with the first conduit, the outlet of the second conduit opening to the inlet of the first conduit via a mixing region;

a third conduit having an inlet and an outlet, the outlet of the third conduit opening to the first conduit via a restriction and the mixing region, wherein a fluid may be fed under pressure through the inlet of the third conduit and conveyed to the mixing region via the restriction to cause a reduction in the pressure of the fluid passing into the mixing region, the reduction in pressure of the fluid causing matter to be sucked through the inlet of the second conduit and conveyed though the second conduit to the mixing region, the matter being entrained with the fluid and exiting the mixing region via the first conduit; and means for promoting a generally helical flow of the fluid through the restriction.

The term "comprising" as used in this specification means "consisting at least in part of"; that is to say when interpreting statements in this specification which include "comprising", the features prefaced by this term in each statement all need to be present but other features can also be present. Related terms such as "comprise" and "comprised" are to be interpreted in a similar manner.

The means for promoting a generally helical flow may comprise a fourth conduit having an outlet opening to the inlet of the third conduit, the fourth conduit being arranged to feed fluid under pressure from the fourth conduit into the third conduit in a direction that promotes a helical flow of the fluid through the restriction.

The third conduit may generally surround the second conduit, and an annular region may be formed between the second and third conduits.

The fourth conduit may be arranged to feed fluid under pressure into the annular region towards the outlet of the third conduit.

The present invention further provides a suction head for relocating matter, the suction head comprising:

a first conduit having an inlet;

a second conduit having an inlet and an outlet, the second conduit being in series and in fluid communication with the first conduit, the outlet of the second conduit opening to the inlet of the first conduit via a mixing region;

a third conduit having an inlet and an outlet, the outlet of the third conduit opening to the first conduit via a restriction and the mixing region, the third conduit generally surrounding the second conduit so as to form an annular region between the second and third conduits, wherein a fluid may be fed under pressure through the inlet of the third conduit and conveyed through the annular region to the mixing region via the restriction to cause a reduction in the pressure of the fluid passing into the mixing region, the reduction in pressure of the fluid causing matter to be sucked through the inlet of the second conduit and conveyed though the second conduit to the mixing region, the matter being entrained with the fluid and exiting the mixing region via the first conduit; and means for promoting a generally helical flow of the fluid within the annular region.

The means for promoting a generally helical flow may comprise a fourth conduit being arranged to feed fluid under pressure into the annular region between the second and third conduits towards the outlet of the third conduit in a direction that promotes a helical flow of the fluid towards the outlet of the third conduit within the annular region.

The fourth conduit may be arranged to feed fluid under pressure into the annular region towards the outlet of the third conduit in a direction that generally makes an angle of between about 30 and 60 degrees with a central axis of the second and third conduits.

The fourth conduit may be arranged to feed fluid under pressure into the annular region in a direction that is generally tangential to both the second and third conduits and offset from a central axis of the second and third conduits.

The means for promoting a generally helical flow may comprise one or more helical vanes or grooves for promoting a helical flow of the fluid through the annular region.

The one or more of the helical vane(s) or groove(s) may be formed on an external surface of the second conduit.

The one or more of the helical vane(s) or groove(s) may be formed on an internal surface of the third conduit.

The helical vane(s) or groove(s) may each make an angle of between about 30 and 60 degrees with a central axis of the second and third conduits.

The suction head may comprise at least one helical vane that substantially extends from an or the external surface of the inner conduit to an or the internal surface of the outer conduit to define a helical passageway through which fluid can flow in the annular region.

At least a part of the second conduit may be movable relative to the third conduit to vary the size of the restriction.

The suction head may comprise an actuator arranged to selectively move the at least a part of the second conduit relative to the third conduit.

The actuator may operatively engage the second conduit outside the annular region so as not to substantially interfere with the flow of fluid through the annular region.

The second conduit may have one or more ports through which fluid in the annular region can pass into the second conduit, and the at least a part of the second conduit may be movable between first and second positions relative to the outer conduit; and when the at least a part of the second conduit is in the first position, the port(s) may be substantially closed to prevent fluid in the annular region passing into the second conduit via the ports(s), and fluid in the annular region may be able to pass to the mixing region via the restriction to suck particulate matter through the inlet of the second conduit, and when the at least a part of the second conduit is in the second position, the restriction may be substantially closed to prevent fluid in the annular region passing into the mixing region via the restriction, and fluid in the annular region may be able to pass through the ports(s) into the second conduit in a direction away from the first conduit to back-flush the second conduit by pushing and/or sucking blockages out of the second conduit.

The second conduit may comprise an inner part and an outer part, the outer part being fixed relative to the third conduit, and the inner part arranged to slidingly move within the outer part.

The port(s) of the second conduit may comprise one or more ports formed in the inner part of the outer conduit and one or more respective ports formed in the outer part of the second conduit; and when the at least a part of the second conduit is in the first position, the port(s) in the inner part and the port(s) in the outer part may be misaligned to prevent fluid in the annular region passing into the second conduit via the ports(s), and when the at least a part of the second conduit is in the second position, the port(s) in the inner part and the port(s) in the outer part may be generally aligned so that fluid in the annular region can pass through the ports(s) into the second conduit.

The third conduit may be generally coaxial with the second conduit.

The restriction may be a generally annular restriction.

The third conduit may converge towards the second conduit to form the restriction between the second and third conduits.

The third conduit may taper towards the second conduit to form the restriction between the second and third conduits.

The tapering part of the third conduit may make an angle of between about 30 and 60 degrees with a central axis of the second and third conduits.

The second conduit may have a generally circular cross-section.

The first conduit may have a generally circular cross-section, the first and second conduits may have substantially constant cross-sections, and the inner diameter of the first conduit may be greater than or substantially equal to the inner diameter of the second conduit so that matter sucked in to the second conduit and through the suction head may be conveyed over a generally unrestricted path through the first and second conduits to inhibit the matter sucked through the inlet of the second conduit blocking the first or second conduits.

The inner diameter of the first conduit may be substantially equal to the inner diameter of the second conduit.

The third conduit may have a generally circular internal cross-section.

The second and third conduits may be generally cylindrical.

The present invention still further provides a dredging device comprising a suction head as defined above.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term "(s)" following a noun means the plural and/or singular form of that noun.

As used herein the term "and/or" means "and" or "or", or where the context allows both.

The invention consists in the foregoing and also envisages constructions of which the following gives examples only.

BRIEF DESCRIPTION OF THE DRAWINGS

The present invention will now be described, by way of non-limiting example only, with reference to the accompanying drawings, in which.

DETAILED DESCRIPTION

Figure 1:
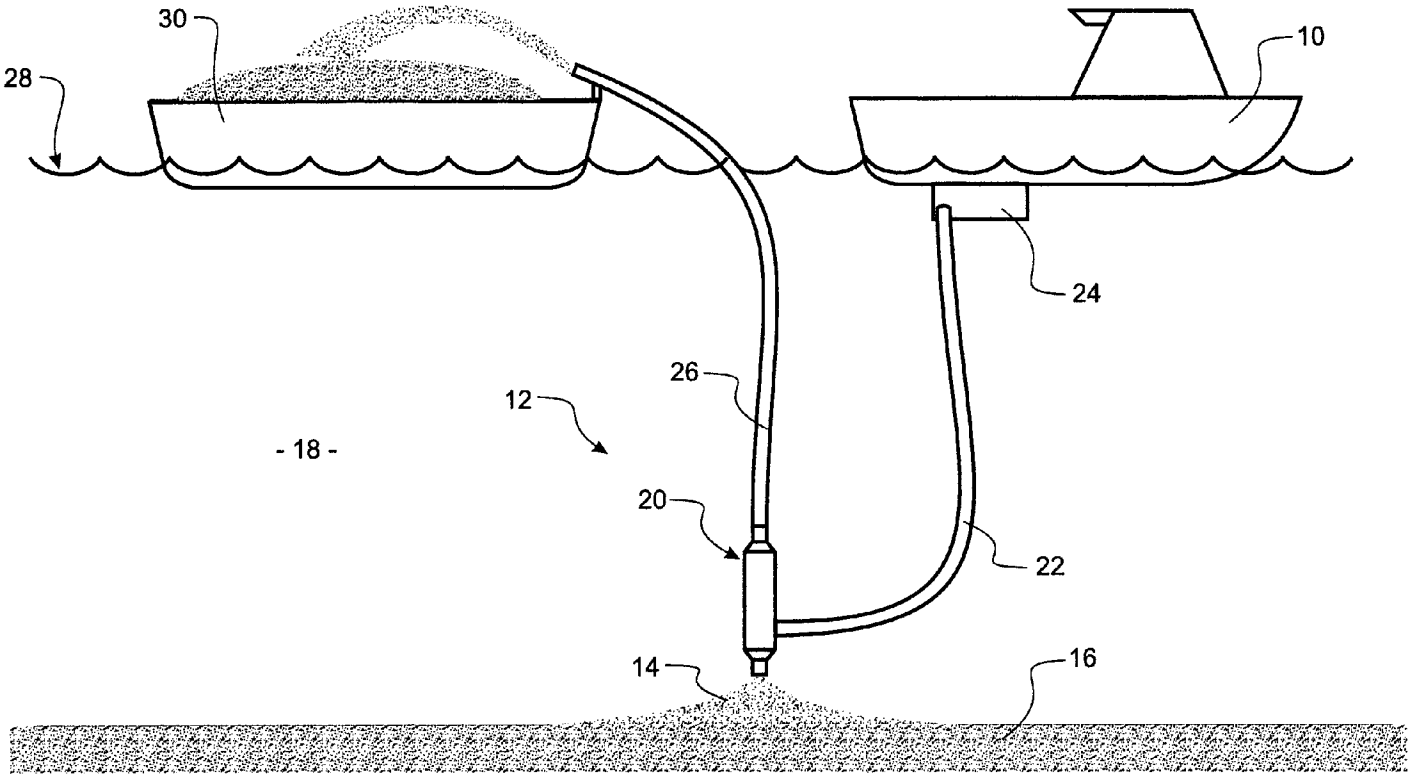
FIG. 1 is a schematic view of a water borne vessel and an embodiment dredging device that is coupled to the vessel and arranged to remove particulate matter from a bed of a body of water.

A water-borne vessel 10 and an embodiment dredging device 12 arranged to suck particulate matter 14 from a bed 16 of a body of water 18, such as the ocean floor, is shown schematically in FIG. 1. The dredging device 12 is coupled to the vessel 10, and comprises a first embodiment suction head 20 through which particulate matter 14 is sucked. The suction head 20 may be mounted to a ROV (not shown) that is controlled from the vessel 10. Alternatively, the ROV and dredging device 12 may be operated from an off-shore platform, such as an off-shore oil platform, for example.

The vessel 10 is coupled to the suction head 20 of the dredging device 12 by a pressurising conduit 22 that may be in the form of pipe and/or hose, for example. The vessel 10 comprises a pump 24 for pumping water or another fluid under pressure to the suction head 20 via the pressurising conduit 22. The pressurised fluid passing through the suction head 20 creates a pressure differential in the suction head 20 that causes a stream of particulate matter 14 and water at a first location to be sucked up through the suction head 20 and entrained with the fluid passing through the suction head 20. The stream of fluid and particulate matter 14 exits the suction head 20 via a discharge conduit 26 that may be in the form of pipe and/or hose, for example, and is conveyed to the surface 28 to a particulate matter collector 30, such as a barge. Alternatively, the particulate matter 14 may be conveyed to any other desired location that is either under water or above water.

Figure 2:
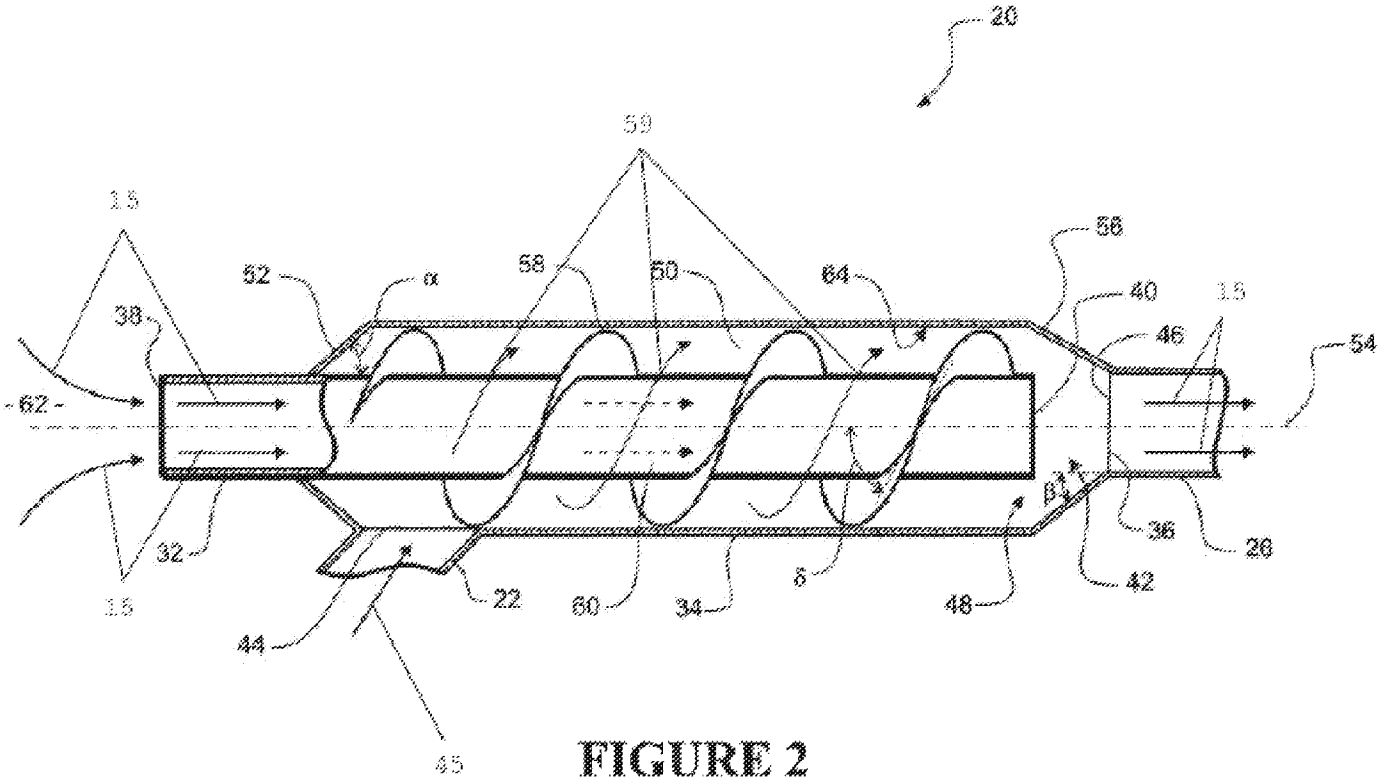
FIG. 2 is a cross-sectional view of a first embodiment suction head of the dredging device shown in FIG. 1.
Figure 3:
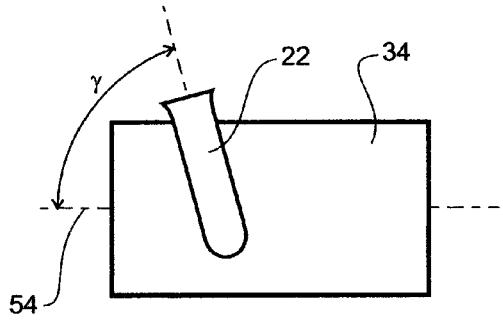
FIG. 3 is a plan view of a section of the outer conduit of the suction head shown in FIG. 2, including the inlet of the outer conduit, and a section of the pressurising conduit for feeding pressurised fluid into the outer conduit.
Figure 4:
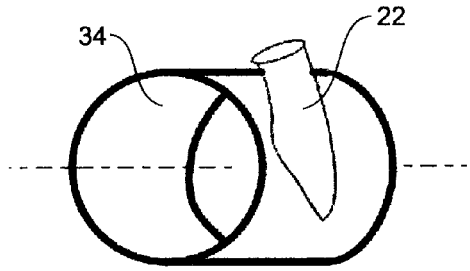
FIG. 4 is a first perspective view of the section of the outer conduit shown in FIG. 3.
Figure 5:
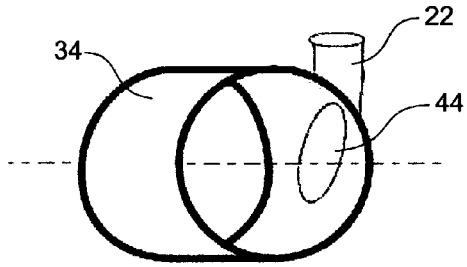
FIG. 5 is a second perspective view of the section of the outer conduit shown in FIG. 3.
Figure 6:
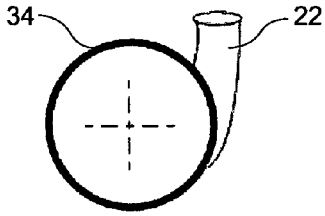
FIG. 6 is an end view of the section of the outer conduit shown in FIG. 3.

The suction head 20 is shown in cross-section in FIG. 2. The suction head 20 comprises the first discharge conduit 26, a second inner conduit 32, and a third outer conduit 34. In FIG. 2, the discharge and outer conduits 26, 34 are shown in cross-section, however, to show the helical vane 58 (discussed below) only the inlet end of the inner conduit 32 is shown in cross-section. Preferably, the discharge, inner and outer conduits 26, 32, 34 all have generally circular cross-sections and are generally cylindrical.

The discharge conduit 26 has an inlet 36. The inner conduit 32 has an inlet 38 and an outlet 40. The inner conduit 32 is in series and fluid communication with the discharge conduit 26, with the outlet 40 of the inner conduit 32 opening to the inlet 36 of the discharge conduit 26 via a mixing region that is generally indicated by the reference number 42. A flexible extending hose (not shown) through which particulate matter 14 can be sucked into the inner conduit 32 can be coupled to the inner conduit 32 at or near inlet 38. The outer conduit 34 has an inlet 44 and an outlet 46, and a constriction that forms a restriction or venturi (generally indicated by the reference number 48) opening to the mixing region 42.

In one embodiment, the discharge, inner and outer conduit 26, 32, 34 may be fixed relative to one another such that the volume of the mixing region is substantially constant.

The inner conduit 32 preferably has generally constant inner and outer diameters along its length. The outer conduit 34 generally surrounds and is coaxial with the inner conduit 32 to define an annular region (generally indicated by the reference number 50) between the inner and outer conduits 32, 34 through which pressurised fluid is fed.

The outer conduit 34 preferably has a substantially constant inner diameter along its length. At a first inlet end, the outer conduit 34 converges to and seals about the inner conduit 32 adjacent the inlet end of the inner conduit 32. As shown in FIG. 2, the inlet end of the outer conduit 34 may have a frustoconical shape, for example, so as to taper (generally indicated by the reference number 52) towards the inner conduit 22 and seal about the inner conduit 32.

The other end of the outer conduit 34 converges and seals about the discharge conduit 26. The outlet end of the outer conduit 34 may also have a frustoconical shape, for example, so as to taper (generally indicated by the reference number 56) to the diameter of the discharge conduit 26, with the tapering part 56 defining the annular restriction or venturi 48 between the inner conduit 32 and the outer conduit 34. The tapering part 56 may make an included angle $\beta$ of between 0 and 90 degrees with the central axis 54, and preferably between about 30 and 60 degrees, for example.

The inner and outer conduits 32, 34 may be formed from stainless steel, for example, although it will be understood that the suction head 20 and conduits may be formed from other suitable material(s). For example, the suction head 20 may be generally formed from other metal alloys, composite resins, plastics and/or polymers, for example.

The outer conduit 34 including the end parts 52, 56 may be about 300-400 mm in length, for example. The inner diameter of the discharge conduit 26 is preferably larger or about the same, and more preferably about the same, as the inner diameter of the inner conduit 32. The inner diameter of the inner conduit 32 and the discharge conduit 26 may be about 4 inches (about 100 mm) and the inner diameter of the outer conduit 34 may be about 6 inches (about 150 mm), for example. It will be understood that these dimensions are provided as a non-limiting example only, however, and any other suitable dimensions may used.

A generally helical vane or rib 58 is formed on an external surface 60 of the inner conduit 32 within the annular region 50. The helical vane 58 generally extends around the inner conduit 32 from the inlet 44 of the outer conduit 34 to near the outlet end of the inner conduit 32. The pitch and length of the vane 58 may be selected so that the vane 58 completes several rotations about the inner conduit 32 along the length of the inner conduit 32 (as shown in FIG. 2), for example, or alternatively the pitch and length may be selected so that the vane 58 completes about a single or less than a single rotation around the inner conduit 32. The generally helical vane 58 advantageously promotes or maintains fluid flowing through the annular region 50 to flow along a helical path 59.

The pitch of the helical vane 58 may be selected so that the helical vane 58 generally makes an included angle $\delta$ with the central axis 54 of between 0 and 90 degrees, and preferably between about 30 and 60 degrees, for example.

The pitch and length of the vane 58, the height the vane 58 extends from the external surface 60 of the inner conduit 32, and the thickness of the vane 58 and the cross-sectional shape (not shown) of the vane 58 may all be selected to suit requirements. Further, the pitch, height, thickness and cross-sectional shape of the vane 58 may not be constant, and may change along the length of the vane 58.

The vane 58 may have a generally rectangular cross-section, and may be about 1-3 mm thick, for example. The vane 58 may extend into the annular region 50 in a direction that is generally perpendicular to the external surface 60 of the inner conduit 32, for example. The height of the vane 58 may be selected so that the vane 58 extends substantially from the external surface 60 of the inner conduit 32 to an internal surface 64 of the outer conduit 34 to define a helical passageway through which fluid can flow in the annular region 50, for example.

The pump 24 is arranged to feed fluid under pressure into the annular region 50 via the fourth pressurising conduit 22. The pressurising conduit 22 is in fluid communication with the outer conduit 34 and arranged to feed fluid 45 into the annular region 50 via the inlet 44.

FIGS. 3 to 6 show sections of the outer conduit 34 and the pressurising conduit 22. The pressurising conduit 22 feeds the fluid in a direction towards the outlet 46 of the outer conduit 34 that makes an included angle $\gamma$ with the central axis 54 of between 0 and 90 degrees, and preferably between about 30 and 60 degrees, for example. Further, with reference in particular to FIG. 6, the pressurising conduit 22 is also arranged to the feed the fluid into the annular region 50 in a direction that is generally tangential to the inner and outer conduit 32, 34 and offset from the central axis 54.

The forward and tangential entry direction of pressurised fluid into the annular region 50 is believed to promote a rotational or helical flow of the fluid within the annular region 50 about the inner conduit 32. This rotational or helical flow towards the outlet 40 is believed to be enhanced and stabilised by the helical vane 54. Preferably, the pitch or the angle $\delta$ that the helical vane 54 makes with the central axis 54 is selected so that the helical vane(s) 54 do not overly restrict the flow of water, but still propagate a vortex in the mixing region 42 and at the inlet 36/outlet 46 where the fluid exits from the mixing region 42 to the discharge conduit 26.

Preferably, the angle $\delta$ that the helical vane 58 makes with the central axis 54 is substantially the same as the entry angle $\gamma$. Alternatively, the angle $\delta$ may be different to the angle $\gamma$.

The pump 24 is preferably manufactured from one or more light-weight, non-metallic materials, such as composite synthetic, thermosetting resins. Manufacturing the pump 24 from one or more light-weight materials is believed to have several advantages, including facilitating safer handling of the pump 24 by reducing the need for heavy lifting equipment, reducing freight and mobilisation costs, and reducing the effect of negative buoyancy when the pump 24 is deployed underwater.

In use, the pump 24 feeds a fluid, such as water, under pressure into the annular region 50 via the inlet 44 in the outer conduit 34. The pressurised fluid is conveyed along the annular region 50 towards the inlet 36 of the discharge conduit 26. The helical vane 58 may be arranged so that the velocity of the fluid in the annular region 50 is about the same as the inlet velocity of the fluid, for example. The fluid passes through the annular restriction 48, preferably causing a jet of fluid to flow past substantially the entire circumference of the outlet 40 of the inner conduit 32 at the mixing region 42. As the fluid passes through the restriction 48 into the mixing region 42, the velocity of the fluid increases. The increase in the velocity of the fluid creates a venturi effect, resulting in a reduction of the pressure of the fluid.

The pressure drop of the fluid causes a corresponding pressure drop within the mixing region 42 and the inner conduit 32. The pressure differential causes a mixture 15 of particulate matter 14 and water around an inlet region (generally indicated by the reference number 62) about the inlet end of the inner conduit 32 to be sucked through the inlet 38. The mixture 15 of water and particulate matter 14 is sucked through the inner conduit 32 to the mixing region 42, where it is entrained with the fluid and exits the mixing region 42 via the discharge conduit 26. The discharge conduit 26 may convey and discharge the mixture of the fluid and the sucked-up particulate matter 14 and water to a collector 30 above the surface or to another location under water, for example.

The suction head 20 comprises means for promoting a generally helical flow of the pressurised fluid. The means for promoting a generally helical flow comprises the pressurising conduit 22 that is arranged to feed the pressurised fluid into the annular region 50 in a direction promoting a generally helical flow of the fluid, and/or the helical vane 58. The helical flow of the pressurised fluid conveyed through the annular region 50 advantageously promotes and/or increases a generally helical or spiralling flow of the fluid through the annular restriction 48. It is believed that the helical flow through the annular region 50 causes the fluid to flow with a slightly higher velocity through the restriction 48 which increases the pressure drop in the fluid that establishes the suction pressure drawing the particulate matter 14 and water 18 through the inner conduit 32.

The helical flow of the fluid conveyed through the annular restriction 48 promotes the propagation a vortex in or near the mixing region 42. It is believed that in this vortex, the fluid flows at a higher speed at the periphery of the vortex and at a lower speed at a central region of the vortex than would otherwise occur. It is believed that the fluid flowing faster at or near the periphery or circumference of the vortex enables larger sucked particles to be more efficiently entrained with the fluid at or near the periphery or circumference, and the fluid flowing slower at or near the central region of the vortex enables smaller sucked particles to be more efficiently entrained with the fluid at or near the central region.

Further, it is believed that the helical flow of the pressurised fluid conveyed through the annular region 50 promotes a more laminar flow of the fluid through the annular restriction 48 than would otherwise occur. It is believed that the more laminar flow of the fluid through the restriction 48 than would otherwise occur also causes or enables the fluid to flow with a slightly a higher velocity through the restriction 48 which increases the pressure drop in the fluid and increases the suction pressure drawing the particulate matter 14 and water 18 through the inner conduit 32.

Further, it is contemplated that flow of the fluid passing through the annular restriction 48 causes a jet of fluid to flow past substantially the entire circumference of the outlet 40 of the inner conduit 32 that also improves the suction pressure drawing the particulate matter 14 and water 18 through the inner tube. This arrangement advantageously minimises the area of the external surface 60 of the inner conduit 32 at the annular restriction 48, which is believed to advantageously reduce pumping losses as the fluid passes through the restriction 48 and enters the mixing region 42.

Advantageously, the inner conduit 32 has a substantially constant inner diameter, and the inner diameter of the discharge conduit 26 is substantially the same or larger than the inner diameter of the inner conduit 32, so that particulate matter 14 sucked through the inlet 38 is inhibited from jamming or blocking the inner conduit 32 or the discharge conduit 26. Preferably, any particulate matter 14 sucked up through the suction head 20 generally travels over an unrestricted equal diameter path through the suction head 20. For example, if the inner diameter of inner conduit 32 is about 4 inches (about 100 mm), the diameter of the path of particulate matter 14 as it is conveyed through the inner conduit 32 and the discharge conduit 26 will be about 4 inches (about 100 mm), and the path of any particulate matter 14 conveyed through the mixing region 42 will be no less than about 4 inches (about 100 mm). This arrangement prevents blockages that may otherwise occur if the diameter of either or both of the discharge conduit 26 and the mixing region 42 were less than the inner diameters of any of the inlet 38, outlet 40 and the inner conduit 32 generally.

Advantageously, the described suction head 20 enables particulate matter 14 and water 18 to be pumped from a first location to a second location by using a surface mounted primary pump that powers the dredging device 12 operating under water. This negates the need for a dedicated under water pump and cables or other power supply.

While the suction head 20 has been described with reference to sucking up particulate matter 14 in water, by sucking up both the particulate matter 14 and the water, it will be appreciated that the suction head 20 may have application to sucking up particulate matter 14 submerged in other liquids. Alternatively, the suction head 20 may be used to suck up particulate matter that is not submerged in liquid.

It will be understood that the use of the suction head 20 is not limited to sucking up particulate matter, such as part of a dredging device. For example, the suction head 20 may be used in applications requiring the mixing of two or more fluids. The liquids may have varying temperatures and/or viscosities, for example. Alternatively, the suction head may be used to transport a corrosive fluid in a sealed environment, which may not be possible with some conventional pumping equipment, for example.

The described suction head 20 may find use in the onshore and offshore oil and mining industries, and may be used on ROVs, drilling rigs and drill ships, for example. The suction head 20 may be used for sub-sea construction, water and land based ore mining, and river and lake construction and repair, for example. Alternatively, the suction head 20 may be used to pump underwater debris to a land based catchment or a settling pond, for example. The particulate matter 14 may include sands, mud's, clays, stones and other particles, for example.

Further, it will be understood that one or more of the suction head(s) may be used with a staged series of pumps (not shown) to pump fluids or materials over a greater distance without having to run the transported fluids or materials through several conventional rotating pumps or conveyors.

Other uses for the suction head 20 will be apparent to the skilled addressee.

The suction head 20 has been described above as having both (1) the pressuring conduit 32 being arranged to feed fluid into the annular region 50 in a direction that promotes a helical flow and (2) the helical vane(s) 58 being formed on the external surface 60 of the inner conduit 32 to promote a helical flow of fluid with the annular region 50. Alternatively, the suction head 20 may include only one of (1) the pressuring conduit 32 being arranged to feed fluid into the annular region 50 in a direction that promotes a helical flow and (2) the helical vane 58 being formed on the external surface 60 of the inner conduit 32 to promote a helical flow of fluid with the annular region 50.

The pressurising, discharge, inner and outer conduits 22, 26, 32, 34 of the suction head 20 preferably all have generally circular cross-sections. Alternatively, however, conduits of the suction head 20 corresponding to the pressurising, discharge, inner and outer conduit 26, 32, 34 may have other, preferably generally round, cross-sections. The conduits forming the conduits 22, 26, 32, 34 may have generally elliptical cross-sections, for example.

The conduits 22, 26, 32, 34 of the suction head 20 may be formed as separate parts that are coupled and sealed to one another during manufacture. Alternatively, two or more of the conduits forming the suction head may be integrally formed as a single part. For example, part of the pressurising conduit 22 and the outer conduit 34 may be integrally formed as a unitary part, and/or the outer conduit 34 and part of the discharge conduit 26 may be integrally formed as a unitary part. Further, it will be understood that where suitable the conduits may be formed by substantially rigid pipe(s) or flexible hose(s), or by a combination of hose(s) coupled to pipe(s), for example.

In one alternative form of the section head 20, two or more helical vanes or ribs 58, may be formed on the external surface 60 of the inner conduit 32. The helical vane(s) 58 may also, or alternatively, be formed on the internal surface 64 of the outer conduit 34 so as to extend into the annular region 50.

In a further alternative form, one or more helical grooves (not shown) may be formed in the external surface 60 of the inner conduit 32 and/or the internal surface 64 of the outer conduit 34 to promote or maintain a helical flow of fluid conveyed through the annular region 50. The cross-sectional shape(s) of the groove(s) may be varied to suit requirements.

The vane(s) or groove(s) may be substantially continuous over the length of the annular region 50, or intermittent, or only extend over part of the length of the annular region 50.

The inner and outer conduit 32, 34 of the suction head 20 are both described as having one inlet each. Alternatively, the inner conduit 32 may have two or more inlets through which the particulate matter 14 may be sucked into the inner conduit 32, and/or the outer conduit 34 may have two or more inlets through which pressurised fluid may be pumped into the annular region 50.

Further, the outer conduit 34 of the suction head has been described and shown as generally being coaxial with and surrounding the inner conduit 32. However, it will be understood that in an alternative arrangement the conduit 34 may be configured to promote a generally helical or annular flow of the fluid through the restriction 48 without being generally coaxial with, or surrounding the, conduit 32 by feeding the fluid directly to the restriction 48.

Figure 7:
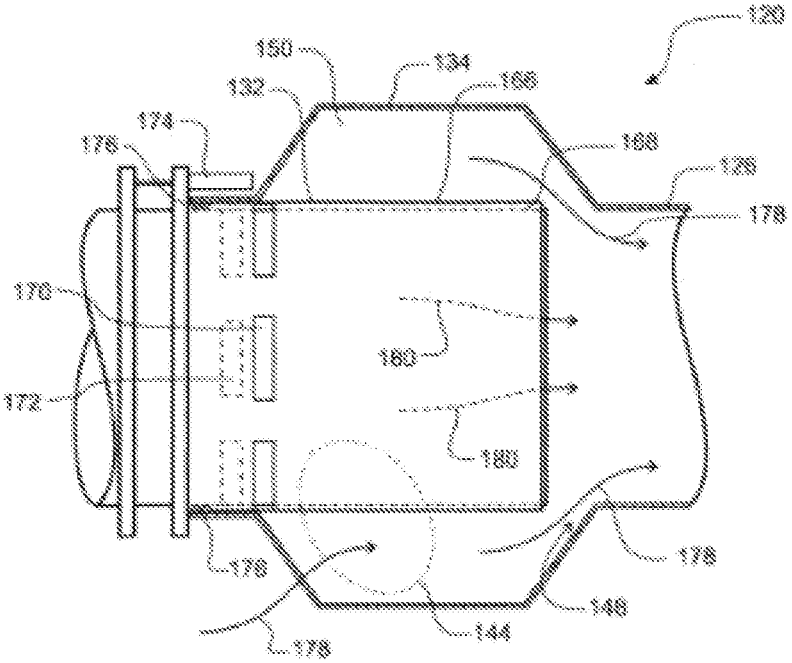
FIG. 7 is a cross-sectional view of a second embodiment suction head, the suction head being shown in a sucking configuration for sucking particulate matter through the suction head.
Figure 8:
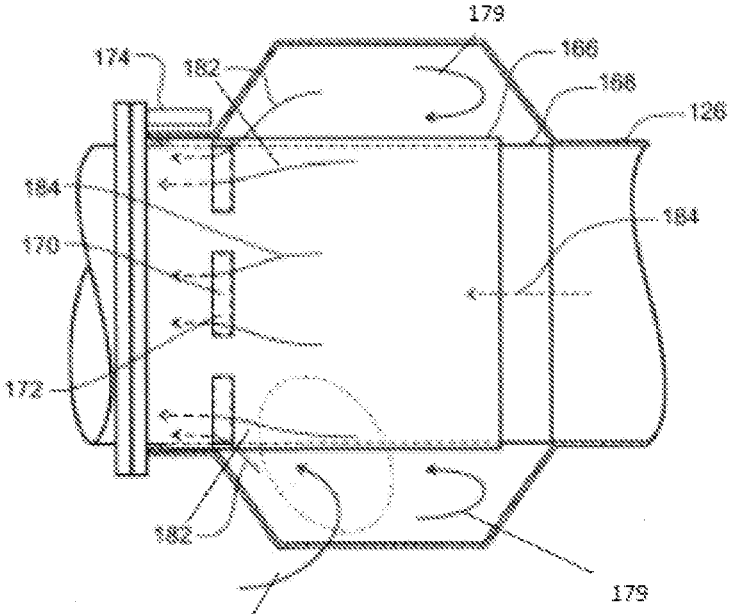
FIG. 8 is a schematic cross-sectional view of the suction head shown in FIG. 7, the suction head being shown in a back-flushing configuration for back-flushing blocked particulate matter from the suction head.

A second embodiment suction head 120 is shown in FIGS. 7-8. Unless described below, the features and operation should be considered to be the same as those described above and like numerals are used to indicate like parts, with the addition of 100.

The reversible-flow suction head 120 comprises a first discharge conduit 126, a second inner conduit 132 and a third outer conduit 134. The outer conduit 134 surrounds the inner conduit 132 to form an annular region 150 between the inner and outer conduits 132, 134. The third conduit 134 is shown in cross-section in FIGS. 7-8 for clarity, so that the part of the second inner conduit 132 within the outer conduit 134 can be seen.

The suction head 120 comprises a fourth pressurising conduit (not shown in FIGS. 7 and 8 for clarity) for feeding pressurised fluid into the annular region 150, as discussed above with reference to the suction head 20. The pressurising conduit is arranged to feed pressurised fluid into the annular region 150 via an inlet 144 of the outer conduit 134 in a direction that generally promotes a helical flow of the pressurising fluid in the annular region 150 towards the discharge conduit 126.

The suction head 120 also comprises one or more vanes (not shown in FIGS. 7-8 for clarity) formed in the annular region 150, as described above with reference to the suction head 20. The vane(s) are arranged to generally promote a helical flow of the pressurised fluid in the annular region 150 towards the discharge conduit 126.

The inner conduit 132 of the suction head 120 comprises an outer casing liner 166 and an inner wear liner 168. The outer liner 166 has ports 170 and is fixed relative to the outer conduit 134. The inner liner 168 has corresponding ports 172 and is arranged for sliding movement relative to the outer liner 166 between at least a first position shown in FIG. 7 and a second position shown in FIG. 8.

The suction head 120 comprises an actuator 174 for moving the inner liner 168 between the first position (FIG. 7) and the second position (FIG. 8). The actuator 174 operatively engages the inner liner 168 outside the annular region 150 so as not to substantially interfere with the flow of fluid through the annular region 150. The suction head 120 comprises o-rings 176 that form a seal between the inner liner 168 and the outer liner 166/outer conduit 134.

The suction head 120 is shown in a sucking configuration in FIG. 7 for sucking particulate matter through the inner conduit 122, and in a back-flushing configuration in FIG. 8 for back-flushing the inner conduit 122 to clear blockages. The operation of the reversible-flow suction head 120 is reversed by moving the inner liner 168 between the first position (FIG. 7) and the second position (FIG. 8) to effectively change the location of an eductor gap of the suction head 20.

In the sucking configuration shown in FIG. 7, an eductor gap is formed at restriction 148. The inner liner 168 is in the first position such that the ports 170,172 are misaligned. The inner liner 168 seals and closes off the outer liner port(s) 170 to prevent fluid in the annular region 150 flowing through the outer liner port(s) 170. Pressurised fluid instead flows through the annular region 150 and restriction 148 (generally indicated by arrows 178) to suck particulate matter (generally indicated by the arrows 180) through the inner liner 168 towards the discharge conduit 126, as described above with reference to the suction head 20.

In the back flushing configuration shown in FIG. 8, the inner liner 168 is in the second position and seals and closes off the restriction 148 to prevent fluid 179 in the annular region 150 passing through the restriction 148. The outer liner port(s) 170 and inner liner port(s) 172 are aligned to define eductor gaps through which pressurised fluid in the annular region 150 can flow into the inner conduit 132 in a direction away from the discharge conduit 126. The pressurised fluid flowing from the annular region 150 and through the aligned port(s) 170, 172 (generally indicated by reference number 182) black flushes or clears the inner conduit 168 by pushing or creating a partial vacuum to suck any blockages out of the inner liner 168 (generally indicated by the arrow 184).

The sliding movement of the inner liner 168 relative to the outer line 170 and/or the outer conduit 134 has been described for opening and closing the restriction 148 and port(s) 150. It will be understood, however, that the inner liner 168 and/or the outer liner 170 may be moved relative to the outer conduit 134 so as to vary the size of the eductor gap defined by the restriction 148 and hence the reduction in pressure of fluid passing through the restriction 148.

EXAMPLE

Figure 9:
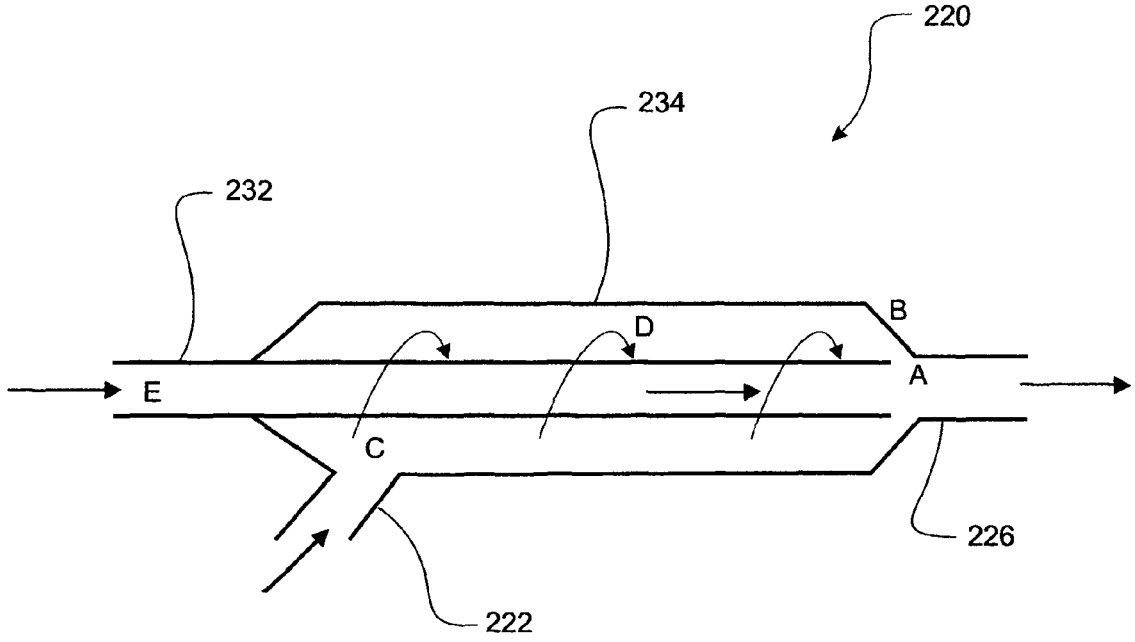
FIG. 9 is a cross-sectional schematic view of an embodiment suction head.

A suction head 220 shown schematically in cross-section in FIG. 9 will now be described by way of the following non-limiting example. Unless described below, the features and operation should be considered to be the same as those described above with reference to suction head 20 and like numerals are used to indicate like parts, with the addition of 200.

The discharge, inner, outer and pressurising conduits 226, 232, 234 and 222 of the suction head all have circular cross-sections. The discharge conduit 226 has an inner diameter of 100 mm, the inner conduit 232 has an inner diameter of 100 mm, the outer conduit 234 has an inner diameter of 150 mmn, and the pressurising conduit 222 has an inner diameter of 75 mm.

Figure 10:
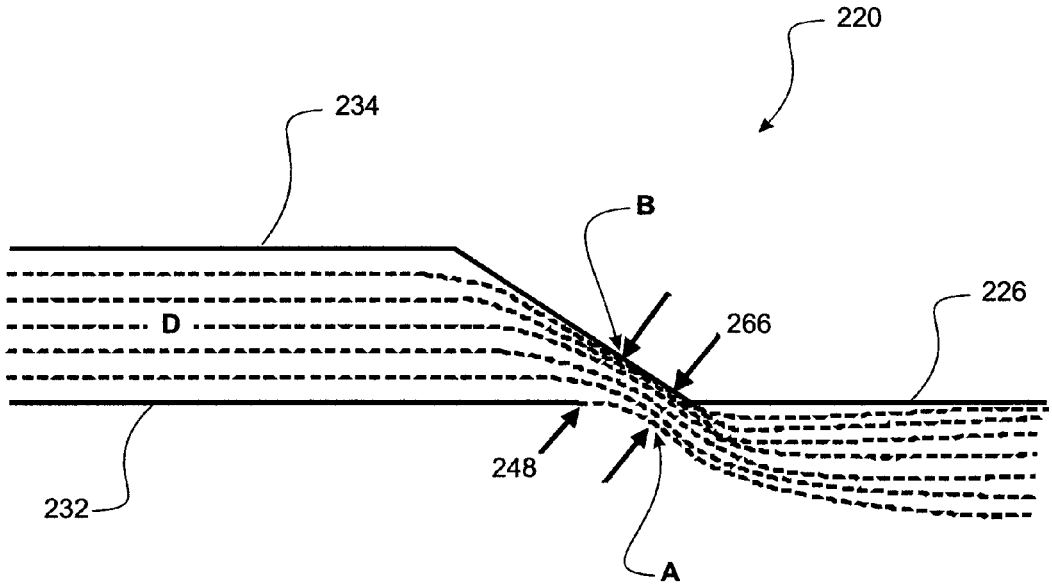
FIG. 10 is a partial cross-sectional view of the restriction of the suction head of FIG. 9 generally showing the fluid flow through the restriction.

The general flow of the fluid through the restriction of the suction head 220 is shown schematically in FIG. 10. In operation, as discussed above, the suction head 220 creates a partial vacuum at location A through the flow of pressurised fluid, such as water, past a restriction or venturi in the form of a narrow gap (generally indicated by reference number 248 in FIG. 10) at location B. Water is pumped tangentially under pressure into the annulus at location C. The suction head comprises one or more helical vanes or ribs (like the vanes 58 of the suction head 220 in FIG. 2, not shown in FIG. 9 for clarity) that maintain a tangential or helical flow up to the annular gap or venturi 248 near location B. On exiting the venturi 248 at high speed, the static pressure of the water in the annular region 50 is converted to velocity head and frictional head losses, and the pressure lowers to create a negative pressure difference between location A and the inlet to the suction head at location E. Under most inlet flow conditions at location C, a differential pressure between locations A and E creates a driving force for suction induced flow at location E. The level of suction obtained at location E is proportional to the level of vacuum created at location A.

The level of vacuum created at location A is very sensitive to the size of the venturi gap 248 at location B and the inlet flow rate at location C. This is illustrated in the worked example below:

Fluid energy analysis:

The fluid energies at locations C and A are compared using the pressure form of the Bernoulli equation:

$$P_C + \frac{\rho V_C^2}{2} = P_A + \frac{\rho V_A^2}{2} + P_{loss} \qquad \text{Eq (1)}$$

where $P_C$=static pressure at location C;

$P_A$=static pressure at location A;

$V_C$=velocity at location C;

$V_A$=velocity at location A;

ρ=fluid density;

g=gravity; and $P_{loss}$=fluid pressure losses resulting from friction.

As fluid passes through the venturi gap 248, the fluid velocity increases dramatically from $V_C$ to $V_A$. This results in a large increase in the dynamic pressure $$\left(\frac{\rho V_A^2}{2}\right)$$

at location A, and a subsequent large decrease in the static pressure ($P_A$) at location A. If the increase in velocity is sufficient, the static pressure at location A can become negative relative to atmospheric pressure (vacuum). $P_A$ becomes a vacuum when $P_A<0$.

By continuity:

$$F=A_C V_C=A_A V_A \quad \text{Eq (2)}$$

where F=inlet volumetric flow rate in $m^3/s$ of the water at location C; and $A_A$ and $A_C$ are the flow areas at locations C and A respectively.

The overall pressure loss, $P_{loss}$, associated with the suction head 220 can also be expressed in terms of the dynamic pressure $$\left(\frac{\rho V_C^2}{2}\right)$$

at location C and the loss coefficient $K_L$.

$$P_{loss} = K_L \frac{\rho V_C^2}{2} \quad \text{Eq (3)}$$

Combining Eq(1), Eq(2) and Eq(3) the vacuum pressure; $P_A$, is able to be predicted.

$$P_A = P_C + \frac{\rho Vc^2}{2}(1-K_L) - \frac{\rho V_A^2}{2} = P_C + \frac{\rho F^2}{2}\left[\frac{(1-K_L)}{A_C^2} - \frac{1}{A_A^2}\right] \quad \text{Eq (4)}$$

The flow area $A_A$ at location A will be less than the venturi gap 248 due to the formation of a vena contracta region, as illustrated schematically in FIG. 10. The actual flow area of the vena contracta (generally indicated by the reference number 266) could be 60% less than the venturi gap 248, for example, depending on the angle of the outer conduit 234 contraction or taper and the flow structure of the fluid prior to the venturi gap 248.

Equation 4 can be applied to typical operating conditions to verify the principle of operation of the suction head 220.

Example operating conditions:

Inlet flow rate, F, of water at location C=680 lpm (litres per minute).

Pressure at location C=30 psig=209.6 kPa gauge (relative to atmosphere).

Pressure at location B=−21.2 in Hg=−71.77 kPa gauge (or 71.77 vacuum pressure).

Venturi gap 168=4 mm.

Estimated vena contracta gap 266 (40% of venturi gap)=1.6 mm.

Loss coefficient $K_L$ is unknown, but could be as high as 10 so will assume $K_L$=9.3.

Water density ρ=1000 $kg/m^3$.

Calculations:

$$\text{Inlet flow rate } F = \frac{680 \text{ Liter}}{\text{min}} * \frac{1 \text{ m}^3}{1000 \text{ Liter}} * \frac{1 \text{ min}}{60 \text{ sec}} = 0.011333 \text{ m}^3/\text{s}$$

Area of pressurising conduit 222, $$A = \frac{\pi\ 0.075 \text{ m}^2}{4} = 4.42\times10^{-3} \text{ m}^2$$

Velocity of fluid entering via the pressurising conduit 222 inlet conduit $$V = \frac{F}{A} = \frac{0.011333 \text{ m}^3/\text{s}}{4.42\times10^{-3} \text{ m}^2} = 2.56 \text{ m/s}$$

The velocity at location C in the annulus, $V_c$, where the pressure is measured, is not known. However the helical vanes or ribs in the annulus will ensure that the velocity remains reasonably similar to the inlet velocity. Therefore for the calculation of the dynamic pressure at location C assume $V_C$ is equal to the velocity of the fluid fed in via the pressurising conduit 222.

Dynamic pressure at location C, $$\frac{\rho V_C^2}{2} = 1000 \text{ kg/m}^3 * \frac{(2.56 \text{ m/s})^2}{2} = 3.28 \text{ kPa}$$

The velocity at A is controlled by the venturi gap 248 and the amount the flow is constricted into the vena contracta 266. Assuming a vena contracta 266 of 1.6 mm the dynamic pressure at A can be estimated.

Area of vena contracta $A_A$=π0.1 m*0.0016 m=$5.03\times10^{-4}$ $m^2$

Velocity at location A, $$V_A = \frac{F}{A_A} = \frac{0.011333 \text{ m}^3/\text{s}}{5.03\times10^{-4} \text{ m}^2} = 22.54 \text{ m/s}$$

Dynamic pressure at location A, $$\frac{\rho V_A^2}{2} = 1000 \text{ kg/m}^3 * \frac{(22.54 \text{ m/s})^2}{2} = 254.03 \text{ kPa}$$

The vacuum pressure at A, $P_A$, can then be calculated using Eq(4).

$$P_A = P_C + \frac{\rho Vc^2}{2}(1-K_L) - \frac{\rho V_A^2}{2} = 209.6 \text{ kPa} + 3.286(1-9.3) \text{ kPa} - 254.03 \text{ kPa} = -71.8 \text{ kPa}$$

The pressure calculated at location A matched closely with a trial value of −71.77 kPa with a vena contracta estimate of 1.6 mm and a loss coefficient $K_L$ of 9.

Figure 11:
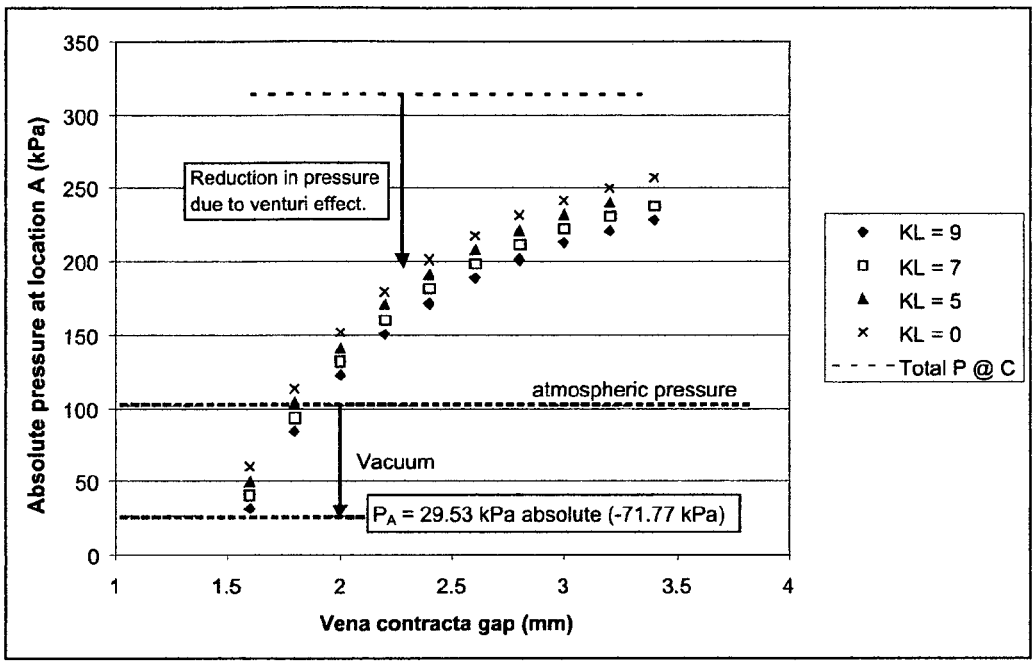
FIG. 11 is a graph of the absolute pressure at the mixing area against the vena contracta gap of an embodiment suction head operating at example conditions.

Since the calculation of the vacuum pressure relied on two variables being assumed, namely the loss coefficient $K_L$ and the vena contracta gap, a sensitivity analysis was undertaken for a range of $K_L$ and vena contracta values. The results are presented in FIG. 11. The vacuum pressure is strongly affected by the vena contracta gap and to a lesser extent the loss coefficient $K_L$. A gap of between 1.5 and 1.6 mm for $K_L$ values from 0 to 9 are required to create an absolute pressure of 29.53 kPa at position A. An absolute pressure of 29.53 kPa corresponds to a vacuum pressure of 71.77 kPa below atmospheric pressure or −71.77 kPa gauge.

For the dredge to work well, a strong vacuum needs to be maintained at location A. This is principally achieved through a high inlet flow and a narrow venturi gap of around 3 to 4 mm.

Preferably, a significant vena contracta of up to 50% reduction is formed to get the vacuum pressures measured. This is indicated from theory and in the calculated data presented in FIG. 3. It has been found that the helical vanes or ribs in the annulus (position D) of the suction head aided the formation of a good vacuum. A possible explanation for the vacuum improvement due to the helical vanes or ribs is that the vanes help to maintain a higher annular flow in the suction head causing a higher $K_L$ loss coefficient. This in turn increases the vacuum that can be obtained for the same venturi gap 48, but comes with a slightly higher pumping power. The helical induced flow through the annulus also persists across the venturi 48 and may also aid the formation of the narrow vena contracta region 266 which is believed through fluid mechanics analysis to be present.

The specific energy in kWh/tonne solids transported for the suction head can be calculated using the following formula.

$$\text{Specific energy}=\text{Pump Head (m)}\times F(\text{m}^3/\text{s})\times 1000\ (\text{kg/m}^3)\times 9.81\ \text{m/s}^2\times 1\ \text{kW}/1000\ \text{W Slurry flow rate}\ (\text{m}^3/\text{h})\times\text{solids concentration (tonne solid/m}^3)$$

Embodiments of the invention have been described by way of example only and modifications may be made thereto without departing from the scope of the invention.

The invention claimed is:

1. A suction head for relocating matter, the suction head comprising:

a first conduit having an inlet;

a second conduit having an inlet and an outlet, the second conduit being in series and in fluid communication with the first conduit, the outlet of the second conduit opening to the inlet of the first conduit via a mixing region;

a third conduit having an inlet and an outlet, the outlet of the third conduit opening to the first conduit via a restriction and the mixing region, wherein a fluid may be fed under pressure through the inlet of the third conduit and conveyed to the mixing region via the restriction to cause a reduction in the pressure of the fluid passing into the mixing region, the reduction in pressure of the fluid causing matter to be sucked through the inlet of the second conduit and conveyed though the second conduit to the mixing region, the matter being entrained with the fluid and exiting the mixing region via the first conduit; and means for promoting a generally helical flow of the fluid through the restriction.

2. A dredging device comprising the suction head as claimed in claim 1.

3. The suction head as claimed in claim 1, wherein the third conduit generally surrounds the second conduit, and an annular region is formed between the second and third conduits.

4. The suction head as claimed in claim 3, wherein the third conduit is adapted to receive fluid from a fourth conduit via an outlet opening of the fourth conduit to the inlet of the third conduit, the fourth conduit being arranged to feed fluid under pressure from the fourth conduit into the annular region between the second and third conduits towards the outlet of the third conduit in a direction that promotes a helical flow of the fluid towards the outlet of the third conduit within the annular region and through the restriction.

5. The suction head as claimed in claim 4, wherein the fourth conduit is arranged to feed fluid under pressure into the annular region towards the outlet of the third conduit in a direction that promotes a generally helical flow and generally makes an angle of between about 30 and 60 degrees with a central axis of the second and third conduits.

6. The suction head as claimed in claim 5, wherein the fourth conduit is arranged to feed fluid under pressure into the annular region in a direction that promotes the generally helical flow and is generally tangential to both the second and third conduits and offset from the central axis of the second and third conduits.

7. The suction head as claimed in claim 6, wherein the generally helical flow is achieved via means comprising at least one helical vane or groove for promoting the helical flow of the fluid through the annular region.

8. The suction head as claimed in claim 7, wherein one or more of the at least one helical vane or groove are formed on either or both an external surface of the second conduit and on an internal surface of the third conduit.

9. The suction head as claimed in claim 8, wherein the at least one helical vane or groove each make an angle of between about 30 and 60 degrees with a central axis of the second and third conduits.

10. The suction head as claimed in claim 9, wherein the at least one helical vane that substantially extends from an external surface of an inner conduit to an internal surface of an outer conduit to define a helical passageway through which fluid can flow in the annular region and through the restriction.

11. The suction head as claimed in claim 10, wherein the restriction through which fluid can flow is variable in size via at least a part of the second conduit being movable relative to the third conduit.

12. The suction head as claimed in claim 11, wherein at least a part of the second conduit is movable relative to the third conduit via an actuator arranged to operatively engage the second conduit to selectively move the at least a part of the second conduit relative to the third conduit so as not to substantially interfere with the flow of fluid through the annular region.

13. The suction head as claimed in claim 12, wherein the second conduit has at least one port through which fluid in the annular region can pass into the second conduit, and the at least a part of the second conduit is movable between first and second positions relative to the outer conduit; and when the at least a part of the second conduit is in the first position, the at least one port is substantially closed to prevent fluid in the annular region passing into the second conduit via the at least one port , and fluid in the annular region can pass to the mixing region via the restriction to suck particulate matter through the inlet of the second conduit, and when the at least a part of the second conduit is in the second position, the restriction is substantially closed to prevent fluid in the annular region passing into the mixing region via the restriction, and fluid in the annular region can pass through the at least one port into the second conduit in a direction away from the first conduit to back-flush the second conduit by one or more of pushing and sucking blockages out of the second conduit.

14. The suction head as claimed in claim 13, wherein the second conduit comprises an inner part and an outer part, the outer part being fixed relative to the third conduit, and the inner part arranged to slidingly move within the outer part.

15. The suction head as claimed in claim 14, wherein the second conduit includes at least one port formed in the inner part of the outer conduit and at least one respective port formed in the outer part of the second conduit; and when the at least a part of the second conduit is in the first position, the at least one port in the inner part and the at least one respective port in the outer part are misaligned to prevent fluid in the annular region passing into the second conduit via the at least one port , and when the at least a part of the second conduit is in the second position, the at least one port in the inner part and the at least one respective port in the outer part are generally aligned so that fluid in the annular region can pass through the at least one port into the second conduit.

16. The suction head as claimed in claim 15, wherein the second conduit is generally coaxial with the third conduit.

17. The suction head as claimed in claim 16, wherein the arrangement of the third conduit relative to the second conduit effects a generally annular restriction formed by either:

a) the third conduit converging towards the second conduit to form the restriction between the second and third conduits; or b) the third conduit tapering towards the second conduit to form the restriction between the second and third conduits.

18. The suction head as claimed in claim 17, wherein the tapering part of the third conduit makes an angle of between about 30 and 60 degrees with a central axis of the second and third conduits.

19. The suction head as claimed in claim 18, wherein:

a) the third conduit has a generally circular internal cross-section.

b) either or both the third conduit and the second conduit are generally cylindrical.

20. The suction head as claimed in claim 19, wherein the second and first conduits have substantially constant cross-sections, and the inner diameter of the first conduit is greater than or substantially equal to the inner diameter of the second conduit so that matter sucked in to the second conduit and through the suction head is conveyed over a generally unrestricted path through the first and second conduits to inhibit the matter sucked through the inlet of the second conduit blocking the first or second conduits.

21. The suction head as claimed in claim 20, wherein either or both the second conduit and the first conduit have a generally circular cross-section.

* * * * *